United States Patent [19]

Vogl et al.

[11] 4,205,916

[45] Jun. 3, 1980

[54] ARTILLERY COLLIMATOR SYMBOL PLATE

[75] Inventors: Georg Vogl, Saltsjöbaden; B. A. Möller, Stockholm; Hans G. Biverot, Stockholm; Josef Novak, Stockholm, all of Sweden

[73] Assignee: Aktiebolaget Bofors, Stockholm, Sweden

[21] Appl. No.: 901,349

[22] Filed: May 1, 1978

[30] Foreign Application Priority Data

May 12, 1977 [SE] Sweden ..... 7705583

[51] Int. Cl.[2] ..... G01C 9/02

[52] U.S. Cl. ..... 356/247; 33/297

[58] Field of Search ..... 356/247, 140, 253; 350/50, 85; 33/245, 246, 297

[56] References Cited

U.S. PATENT DOCUMENTS

| | | | |
|---|---|---|---|
| 2,450,712 | 10/1948 | Brown | 356/247 |
| 3,752,591 | 8/1973 | Feldman | 356/247 |

FOREIGN PATENT DOCUMENTS

| | | | |
|---|---|---|---|
| 667533 | 7/1963 | Canada | 356/247 |
| 2736598 | 2/1978 | Fed. Rep. of Germany | 356/247 |
| 188996 | 4/1964 | Sweden . | |

*Primary Examiner*—John K. Corbin
*Assistant Examiner*—B. W. de los Reyes
*Attorney, Agent, or Firm*—James & Franklin

[57] ABSTRACT

A symbol plate for an artillery collimator and an artillery gun sight has a vertical center line across the plate and symbols arranged in a row symmetrically in relation to the center line. The symbols are formed of digits which are arranged to indicate numeral values proportionally variable with the distance to the center line, the digits being arranged with opposite inclination on opposite sides of the center line.

7 Claims, 6 Drawing Figures

ARTILLERY COLLIMATOR SYMBOL PLATE

BACKGROUND OF THE INVENTION

The present invention relates to a symbol plate for an artillery collimator and an artillery gun sight, said plate having symbols, arranged in a row, symmetrically in relation to a vertical center line across the plate, said symbols indicating the distance to the center line.

For the control and adjustment of the zero position of artillery guns an artillery collimator is used. It comprises a lens system (similar to a photo objective, but better), in the focal plane of which a translucent symbol plate is located. In the sight of the gun a similar symbol plate is located. Angles defined by the distances of the symbols from the optical axis must be exactly equal in both instruments.

Upon firing the gun is usually displaced a few decimeters forwards or backwards, which does not affect the alignment. It is, on the other hand, necessary to observe whether the gun then has performed an angular movement, and in such case correct this on the side scale of the sight. FIG. 1, illustrates the situation. The collimator is positioned 10 to 20 meters from the gun, and directed with its tracking telescope towards the sight of the gun. The person aiming the gun sees the collimator objective in his sight as a small bright disc and one or more symbols $S_1$ therein. He aims the sight until these marks coincide with the corresponding symbols $S'_1$ on the aiming plate of the sight (FIG. 1*a*). After the firing, in the case where the gun has rotated, the person aiming sees another symbol $S_n$, which covers a symbol $S'_n$ in the sight (FIG. 1*b*). He then turns the sight, until the symbol $S_n$ covers the corresponding symbol $S'_n$ on aiming plate of the sight. The gun is then again positioned in the correct angular position (FIG. 1*c*).

The collimator is usually placed at a distance of 10 to 20 meters from the gun, which means that its objective must be provided with a diameter of 70 to 80 mm in order to be observable as a bright disc with 4 mrad diameter at 20 meters. If it then is desirable to see 1.5 to 2 symbols in this disc, their dimension must be about 2 mrad. Since the sight of an artillery gun usually has a four times magnification, the image of the symbols in the ocular will be about 8 mrad, which can be considered to be sufficient for troublefree reading.

If it is presumed that the gun moves ±1 meter as a maximum, the row of symbols (at a distance of 10 meters between the collimator and the sight) must be about ±100 mrad (milliradians) long as between 50 and 100 symbols are required in each direction counted from the vertical symmetry plane (center of aiming plate—optical axis). These symbols must be easily readable, must not give the slightest possibility of confusion, must give information about whether just the symbol in sight is located to the right or to the left of the axis, and the distance to said axis. The device must be quite usable even for weary staff in stress condition.

Up to the present designed symbol rows consisting of letters have been used (see FIG. 2*b*), but since the alphabet is not sufficient, certain letters have been turned upside down or reversed. Letters or digits can be combined or purely imaginary figures can be used. There is a risk that such a symbol system causes wrong aiming, accidents and possibly renders this system unusable in practice.

Accordingly, it is an object of the present invention to provide a symbol plate which facilitates adjustment of the sight.

Another object is to provide such a symbol plate which provides unique, easy to read, easy to understand and easy to communicate symbols.

SUMMARY OF THE INVENTION

It has now been found that the above related objects of the present invention are obtained in a symbol plate in which the symbols are formed of digits which are arranged to indicate numeral values proportionally variable with the distance between the symbols and the center line, the digits being arranged with opposite inclination on opposite sides of the center line.

More particularly, the symbol plate for an artillery collimator and an artillery gun sight has a vertical center line across the plate and symbols arranged in a row symmetrically in relation to the center line. The symbols are formed of digits which are arranged to indicate numeral values proportionally variable with the distance between the symbols and the center line, the digits being arranged with opposite inclination on opposite sides of the center line. Preferably the digits to the left of the center line are inclined leftwards and the digits to the right of the center line are inclined rightwards, or vice versa.

In a preferred embodiment the digits are adapted to indicate numeral values proportionally increasing with the distance between the symbols and the center line. Preferably the digits are equally and oppositely inclined at either side of the center line.

Preferably the digits are adapted to indicate directly the numeral value of the angle between the optical axis in the device in which the plate is intended to be used and the direction defined by the distance between the optical axis and the position of the digits in question.

BRIEF DESCRIPTION OF THE DRAWING

FIG. 2(*b*) is a schematic representation of the symbols used in prior art symbol plates.

DETAILED DESCRIPTION OF THE PREFERRED EMBODIMENTS

According to the invention the symbols (FIG. 2*a*) consist only of digits, preferably from 10 to 99, which are inclined towards the optical axis (center of plate). They may possibly also indicate the angle in mrad, which facilitates the adjustment of the sight.

This measure makes it easy to read the angular adjustment (the pattern recognition of the eye is better for digits than for letters or imaginary pictures); immediate information is obtained regarding distance and direction to the center (one knows eg. that "60" is far out). At the final adjustment the shape of the adjacent symbols is known (one knows that after "23" comes "24"—but not all persons know immediately that after "P" comes "Q", they restart from "A"). At instruction and communication it is easy and fast to say e.g. "62 right"—it is more difficult to communicate e.g. "reversed Z to the right". Upon adjustment two signals are brought into coincidence, e.g. "18" inclined to the left in coincidence with "18" on the target of the sight. It is unique and any confusion with "18" to the right is excluded.

Figure 1A:
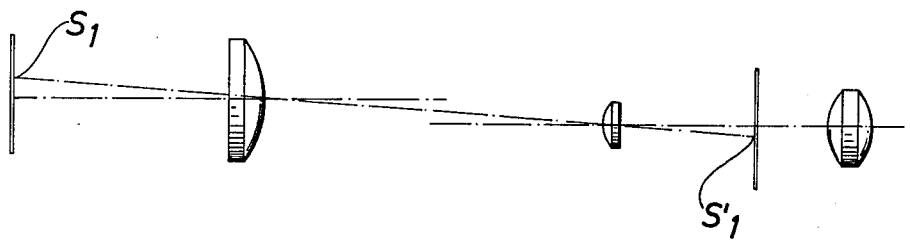
FIGS. 1(*a*), (*b*) and (*c*) are schematic representations of an artillery collimator and an associated gun sight, FIG. 1(*a*) showing the collimator and gun sight in an initial aligned position, FIG. 1(*b*) showing the collimator and gun sight out of alignment due to rotation of the gun after firing, and FIG. 1(*c*) showing the collimator gun sight realigned.
Figure 1B:
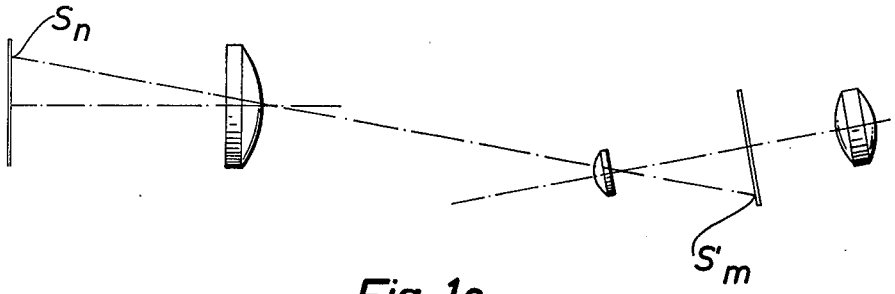
Figure 1C:
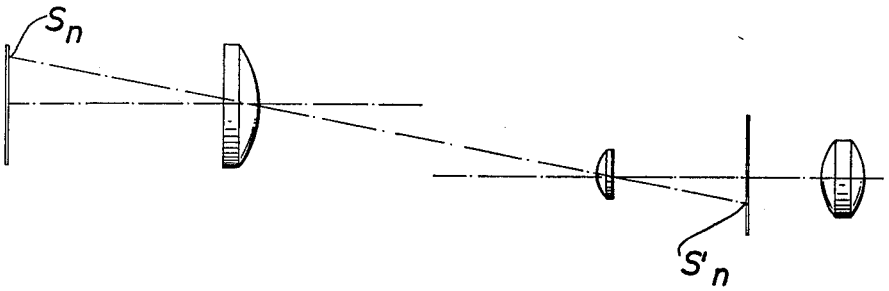
Figure 2A:
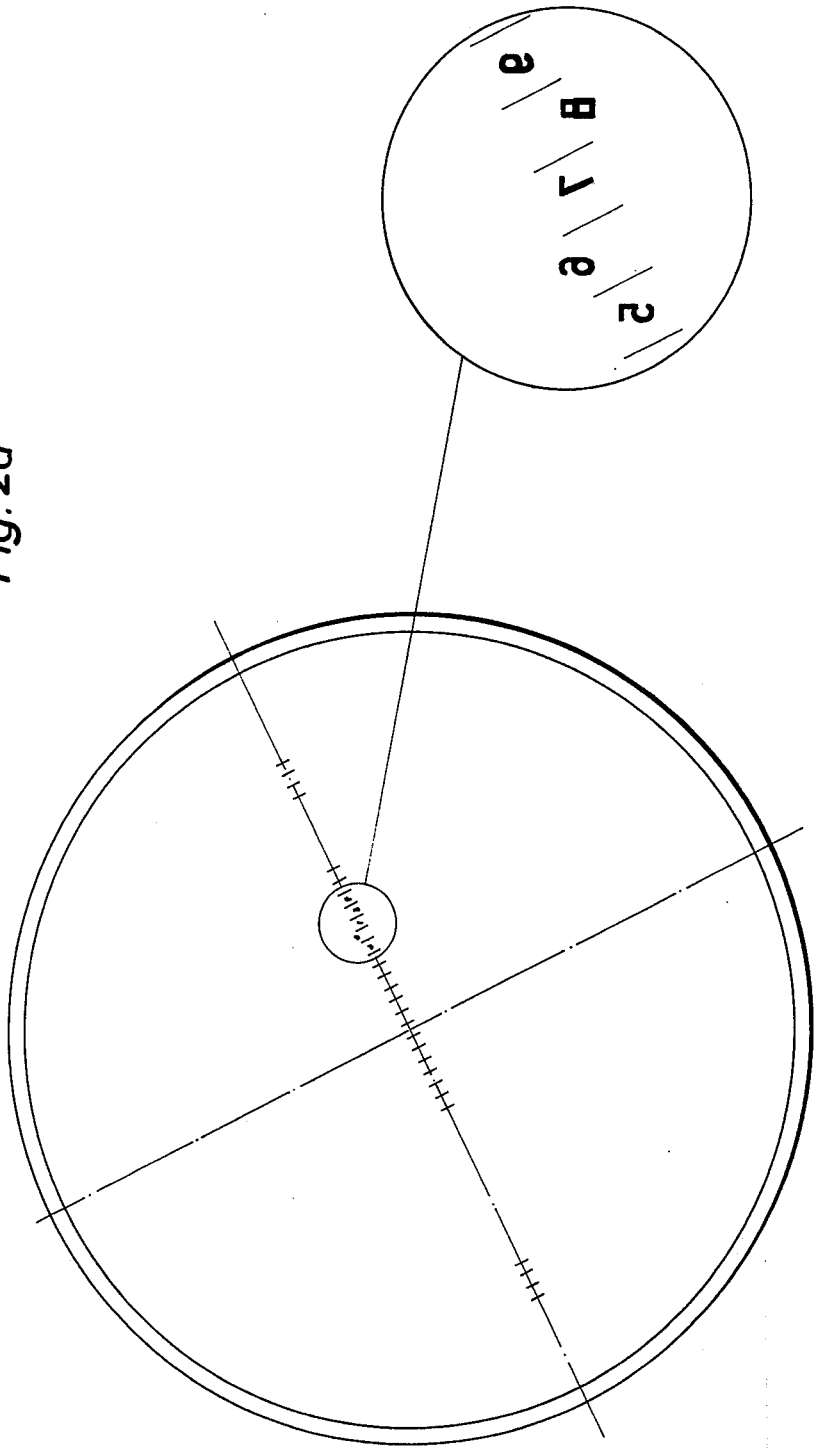
FIG. 2(*a*) is a front elevation view of a symbol plate according to the present invention, a portion thereof being shown in an enlarged view for the sake of clarity.
Figure 2B:
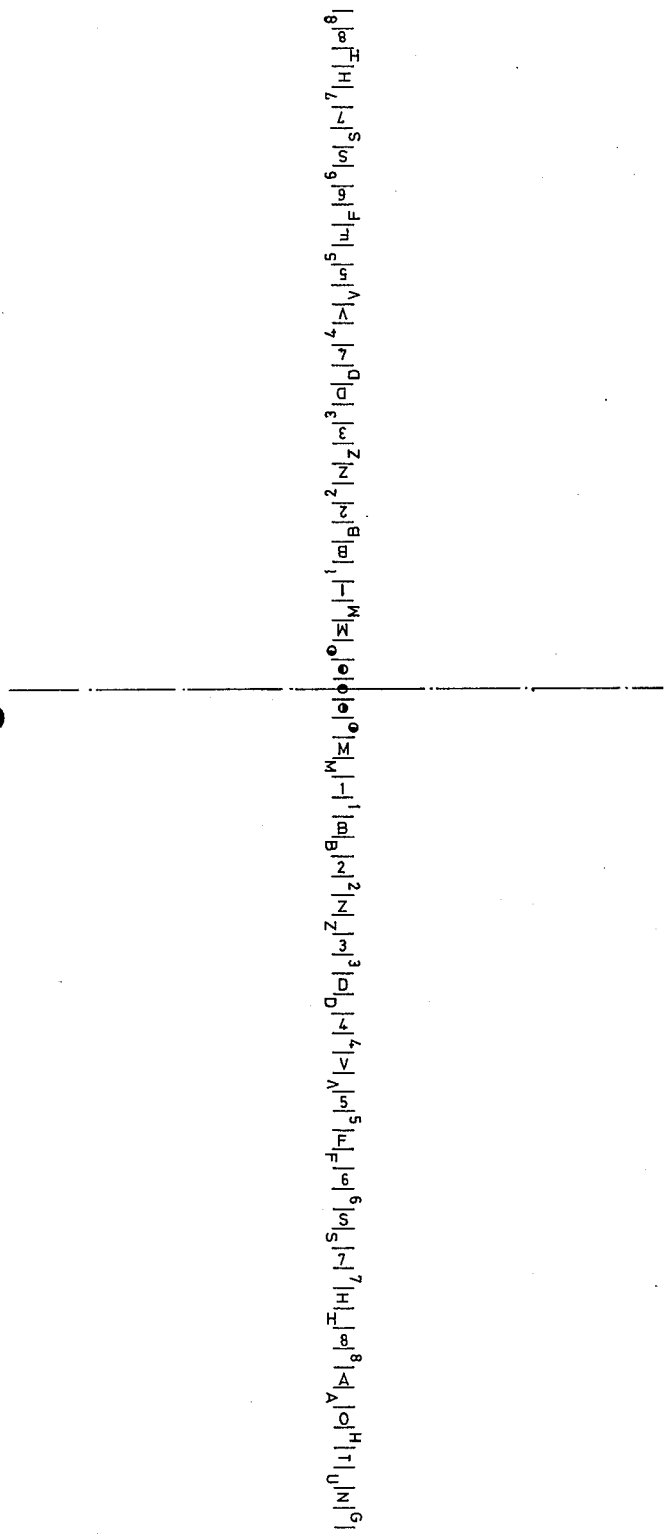
Figure 3:
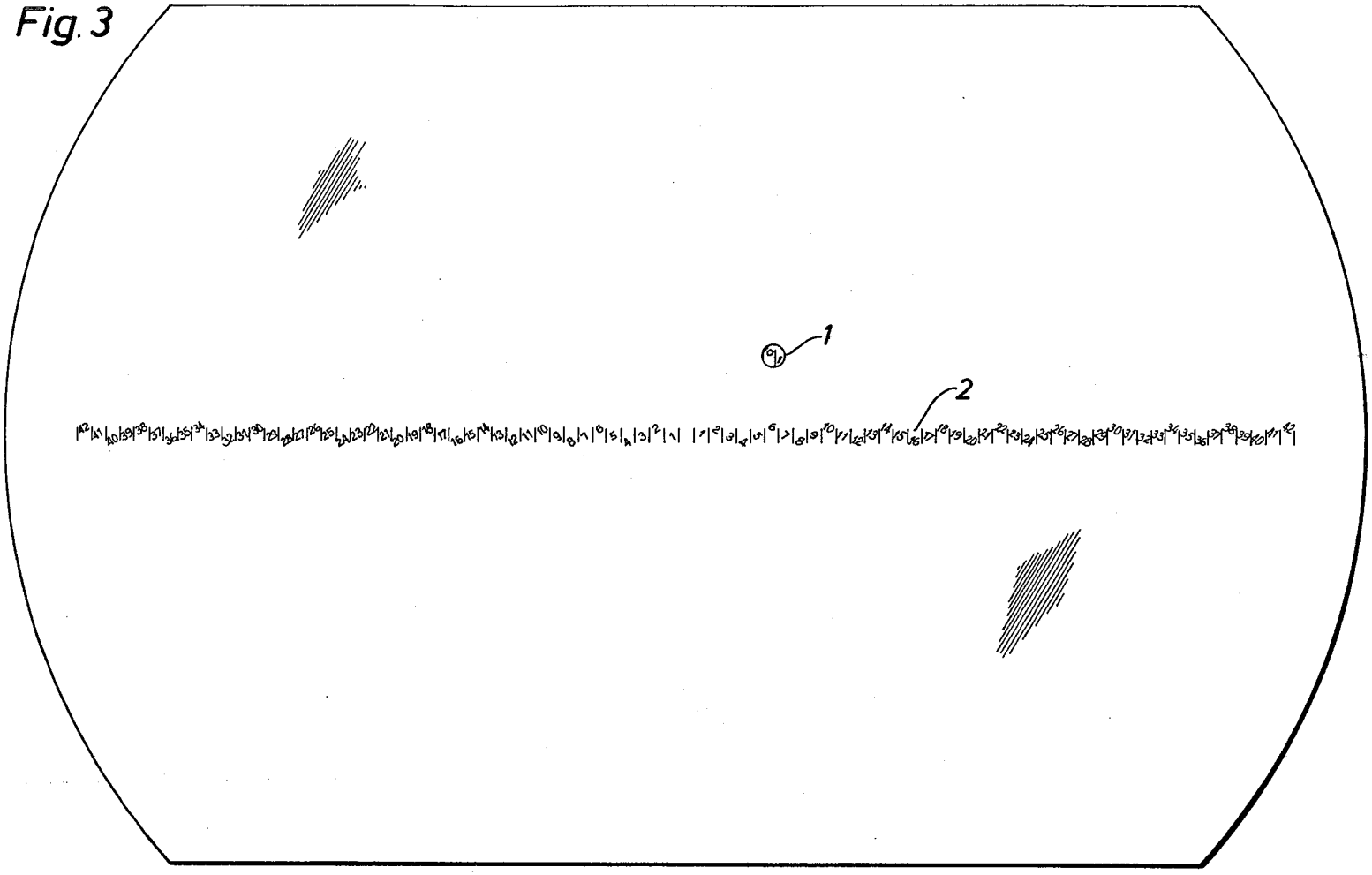
FIG. 3 is a schematic view of the field of view in the ocular of the gun sight when the coincidence between the two symbol plates is not completely adjusted.

FIG. 2*a* shows the design of the symbol plate in the sight. FIG. 2*b* illustrates the symbol plate as it is usually used. FIG. 3 show the field of view in the oscular of the sight, when the coincidence intentionally is not completely adjusted. The ring 1 is the collimator objective $\phi 75$ seen at a distance of 20 m. The row 2 is located on the aiming plate of the sight.

We claim:

1. In a symbol plate for an artillery collimator and an artillery gun sight, said plate having a vertical center line across said plate and symbols arranged in a row symmetrically in relation to said center line, the improvement wherein said symbols are formed of digits which are arranged to indicate numeral values proportionally variable with the distance between said symbols and said center line, said digits being arranged with opposite inclination on opposite sides of said center line.

2. The plate of claim 1 wherein said digits are adapted to indicate directly the numeral value of the angle between the optical axis in the device in which said plate is intended to be used and the direction defined by the distance between said optical axis and the position of the digits in question.

3. The plate of claim 1 wherein said digits are adapted to indicate numeral values proportionally increasing with said distance.

4. The plate of any of claims 1 through 3 wherein said digits are equally and oppositely inclined at either side of said center line.

5. In a symbol plate for an artillery collimator and an artillery gun sight for lateral alignment, said plate having a vertical center line across said plate and through the optical axis of the device in which the plate is intended to be used, and symbols arranged in a row symmetrically in relation to said center line which symbols indicate the distance to said center line, the improvement wherein said symbols are formed of digits which are arranged to indicate numeral values proportionally increasing or proportionally decreasing with the distance between said symbols and said center line on either side thereof, said digits being inclined to the left to the left of said center line and to the right to the right of said center line or vice versa.

6. The plate of claim 5 wherein said digits are adapted to indicate directly the numeral value of the angle between the optical axis in the device in which said plate is intended to be used and the direction defined by the distance between said optical axis and the position of the digits in question.

7. The plate of any of claims 5 or 6 wherein said digits are equally inclined at either side of said center line.

* * * * *